US006590506B1

(12) United States Patent
Oouchi

(10) Patent No.: US 6,590,506 B1
(45) Date of Patent: Jul. 8, 2003

(54) ON-BOARD DSRC APPARATUS

(75) Inventor: Jun Oouchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 446 days.

(21) Appl. No.: 09/703,729

(22) Filed: Nov. 2, 2000

(30) Foreign Application Priority Data

Mar. 23, 2000 (JP) ..... 2000-081524

(51) Int. Cl.[7] ..... G08G 1/01

(52) U.S. Cl. ..... 340/933; 340/928; 340/687; 343/713; 235/384

(58) Field of Search ..... 340/933, 928, 340/10.1, 10.3, 686.1, 687; 343/713, 711; 235/384, 380; 455/99

(56) References Cited

U.S. PATENT DOCUMENTS 6,175,791 B1 * 1/2001 Oouchi ..... 701/36
6,300,882 B1 * 10/2001 Inoue ..... 340/933
6,337,622 B1 * 1/2002 Sugano ..... 340/438
6,337,978 B1 * 1/2002 Inoue ..... 455/421
6,339,381 B1 * 1/2002 Takikita ..... 340/901
6,356,207 B1 * 3/2002 Oouchi ..... 340/928
6,421,017 B1 * 7/2002 Inoue ..... 343/713

* cited by examiner

*Primary Examiner*—Nina Tong
(74) *Attorney, Agent, or Firm*—Sughrue Mion, PLLC

(57) ABSTRACT

The present invention provides an on-board DSRC apparatus for communicating with the associated one of on-road communication machines, in which the on-board DSRC apparatus is capable of coping readily with the repurchase of a vehicle, and with the change of the preference of a user while maintaining a communication area fixed before and after having changed the type of, the on-board DSRC apparatus, and has high degree of freedom of installation of the body of the on-board DSRC apparatus. A body of an on-board DSRC apparatus which is connected to an antenna unit includes a transmission unit and a reception unit which are associated with the antenna unit. Also, the body of the on-board DSRC apparatus includes switch means for operating in response to the presence or absence of a cable which is selectively inserted between the antenna unit and the body of the on-board DSRC apparatus, and changing means for changing the attenuation amount of the transmission unit and the reception unit in response to the operation of the switch means. The changing means corrects the attenuation amount in such a way as to compensate for the change of the cable loss due to the presence or absence of the cable.

6 Claims, 4 Drawing Sheets

ON-BOARD DSRC APPARATUS

BACKGROUND OF THE INVENTION

1. Field of the Invention

The present invention relates in general to an on-board DSRC (Dedicated Short-Range Communication) apparatus for use in an ETC (Electronic Toll Collection) system or the like of an ITS (Intelligent Transport System), and more particularly to an on-board DSRC apparatus in which the degree of freedom in installing an antenna unit and a body of the on-board DSRC apparatus is improved.

2. Description of the Related Art

In general, in an on-board DSRC apparatus for use in an ETC system or the like, in order that the communication between the on-board DSRC apparatus and the associated one of on-road communication machines for charge collection may be efficiently carried out, the position where an antenna unit is installed is limited to a dash board or the like of a vehicle.

On the other hand, since a body of the on-board DSRC apparatus may be installed in an arbitrary position of a vehicle in dependence on the convenience of a user, there is two cases, i.e., one case where the body of the on-board DSRC apparatus is constructed integrally with the antenna unit and the other case where the body of the on-board DSRC apparatus is connected to the antenna unit through a cable laid therebetween. From the foregoing, as for the types of the conventional on-board DSRC apparatuses, there are present a two-piece type in which the body of the on-board DSRC apparatus is constructed integrally with the antenna unit (in general, referred to as "the two-piece type" in order to distinguish between the integral one-piece part and an external storage medium which is connected to the body of the on-board DSRC apparatus), and a three-piece type in which the body of the on-board DSRC apparatus is constructed separately from the antenna unit.

There is no wide application between the above-mentioned two types of on-board DSRC apparatuses. Therefore, after a user once has selected and purchased the associated one of the two types of on-board DSRC apparatuses, in the case where the installation of the body of the on-board DSRC apparatus, for example, is changed, even when the user intends to change the type of the on-board DSRC apparatus from the two-piece type over to the three-piece type, the specification thereof can not be changed at all.

Therefore, in the case where the change request made by a user occurs, there is no way except that the three-piece type of on-board DSRC apparatus is newly repurchased.

As for an example in which the change request made by a user occurs, there is the case where after a user has purchased the three-piece type of on-board DSRC apparatus and installed it to a vehicle, he/she repurchases a new vehicle to find that the three-piece type of on-board DSRC apparatus is excellent in the field of vision and also does not spoil the appearance of the interior of a vehicle, as compared with the two-piece type of on-board DSRC apparatus. In such a case, the on-board DSRC apparatus is desirable in which the type may be changed from the two-piece type over to the three-piece type.

However, when the type of the on-board DSRC apparatus is intended to be simply changed from the three-piece type over to the two-piece type (or from the two-piece type over to the three-piece type), the cable becomes unnecessary (or newly necessary), but the communication characteristics of the on-board DSRC apparatus changes as follows in dependence on the presence or absence of the cable.

In general, the cable for high-frequency transmission has the loss inherent therein and hence the presence or absence of the cable leads to the presence or absence of the loss.

For example, in the case of the three-piece type of on-board DSRC apparatus, in general, the correction needs to be carried out for the cable loss in the circuit characteristics of the body of the on-board DSRC apparatus.

In general, the cable loss in the vicinity of the frequency of 6 GHz is in the range of about 1.0 dB to about 2.0 dB per meter. Thus, assuming that the cable length is 3 m for example, the cable loss of 3 dB to 6 dB occurs.

The above-mentioned loss amount is related to the communication area between the on-board DSRC apparatus and the associated one of the on-road communication machines for charge collection, and hence the presence or absence of the cable exerts an influence on the spreading or reducing of the communication area.

In particular, in the case where the high-frequency wave is employed as the carrier wave as in the on-board DSRC apparatus, since the cable loss is large and also the fluctuation of the sensitivity and the transmission output due to the change of the type of the on-board DSRC apparatus (i.e., the presence or absence of the cable) is large, the type can not be changed only by simply removing or adding the cable therefrom or thereto.

As described above, in the conventional on-board DSRC apparatus, since the two types of products are separately handled, in order to change the type of the on-board DSRC apparatus from one type over to the other type, it is necessary to repurchase a new type of on-board DSRC apparatus. This is a problem associated with the prior art.

In addition, when the type of the on-board DSRC apparatus is intended to be charged from one type over to the other type only by removing or adding the cable therefrom or thereto, since the fluctuation of the sensitivity and the transmission output in change of the type is large, the communication area is changed. Thus, in the end, the type of the on-board DSRC apparatus can not be changed. This is another problem associated with the prior art.

SUMMARY OF THE INVENTION

In the light of the foregoing, the present invention has been made in order to solve the above-mentioned problems associated with the prior art, and it is therefore an object of the present invention to provide an on-board DSRC apparatus, having the high degree of freedom of installation of an antenna unit and a body of the on-board DSRC apparatus, in which the fluctuation of the cable loss due to the presence or absence of a cable is automatically switched and corrected on the on-board DSRC apparatus body side, thereby being able to cope readily with the repurchase of a vehicle or the change due to the preference of a user while maintaining a communication area fixed before and after having changed the type of the onboard DSRC apparatus from one type over to the other type.

According to one aspect of the present invention, there is provided an on-board DSRC apparatus comprising an antenna unit mounted on a vehicle, and a body of the on-board DSRC apparatus mounted on the vehicle to be connected to the antenna unit, the body including a transmission and reception units associated with the antenna unit to communicate with the associated one of on-road communication machines that is installed on a travelling road for the vehicle, in which the body of the on-board DSRC apparatus comprises switch means for operating in response to the presence or absence of a cable which is selectively inserted between the antenna unit and the body of the on-board DSRC apparatus, and changing means for changing the attenuation amount of the transmission and reception units in response to the operation of the switch means, and in which the changing means corrects the attenuation amount in such a way as to compensate for the fluctuation of the cable loss due to the presence or absence of the cable.

According to another aspect of the present invention, there is provided an on-board DSRC apparatus in which the switch means is constituted of:

a projecting part which is provided on the surface side of the antenna unit facing the body of the on-board DSRC apparatus;

a recess part which is provided on the surface side of the body of the on-board DSRC apparatus facing the antenna unit;

and an opening and closing switch which is turned on by inserting the projecting part into the recess part.

According to still another aspect of the present invention, there is provided an on-board DSRC apparatus in which the switch means is constituted of a magnet member which is provided on the surface side of the antenna unit facing the body of the on-board DSRC apparatus, and a magnetic switch which is provided on the surface side of the body of the on-board DSRC apparatus facing the antenna unit and which is turned on by making the magnet member come close to the magnetic switch.

According to yet another aspect of the present invention, there is provided an on-board DSRC apparatus in which the changing means is constituted of a control unit which is operated by turning on the switch means, and a variable attenuator for carrying out the correction in such a way as to increase the attenuation amount of the transmission and reception units in response to the drive by the control unit.

In addition, according to yet another aspect of the present invention, there is provided an on-board DSRC apparatus in which the changing means is constituted of high-frequency switches for carrying out the change operation in conjunction with the on operation of the switch means, and a fixed attenuator which is selectively connected to the transmission and reception units through the high-frequency switches.

Also, according to yet another aspect of the present invention, there is provided an on-board DSRC apparatus in which the body of the on-board DSRC apparatus includes a controller of the on-board DSRC apparatus for processing communication information which has been transmitted and received through the transmission and reception units, and a storage medium insertion unit into which an external storage medium is inserted to and from which the information relating to the charge collection is transmitted and received through the controller of the on-board DSRC apparatus, and in which the body exchanges the information relating to the charge collection with the associated one of on-road communication machines for charge collection which is installed on a toll road for the vehicle, and automatically carries out the charge collection on the basis of the information relating to the charge collection.

BRIEF DESCRIPTION OF THE DRAWINGS

The above and other objects as well as advantages of the present invention will become clear by the following description of the preferred embodiments of the present invention with reference to the accompanying drawings, in which.

DETAILED DESCRIPTION OF THE PREFERRED EMBODIMENTS

Preferred embodiments of the present invention will hereinafter be described in detail with reference to the accompanying drawings.

First Embodiment

A first embodiment of the present invention will hereinbelow be described with reference to the associated drawings.

Figure 1:
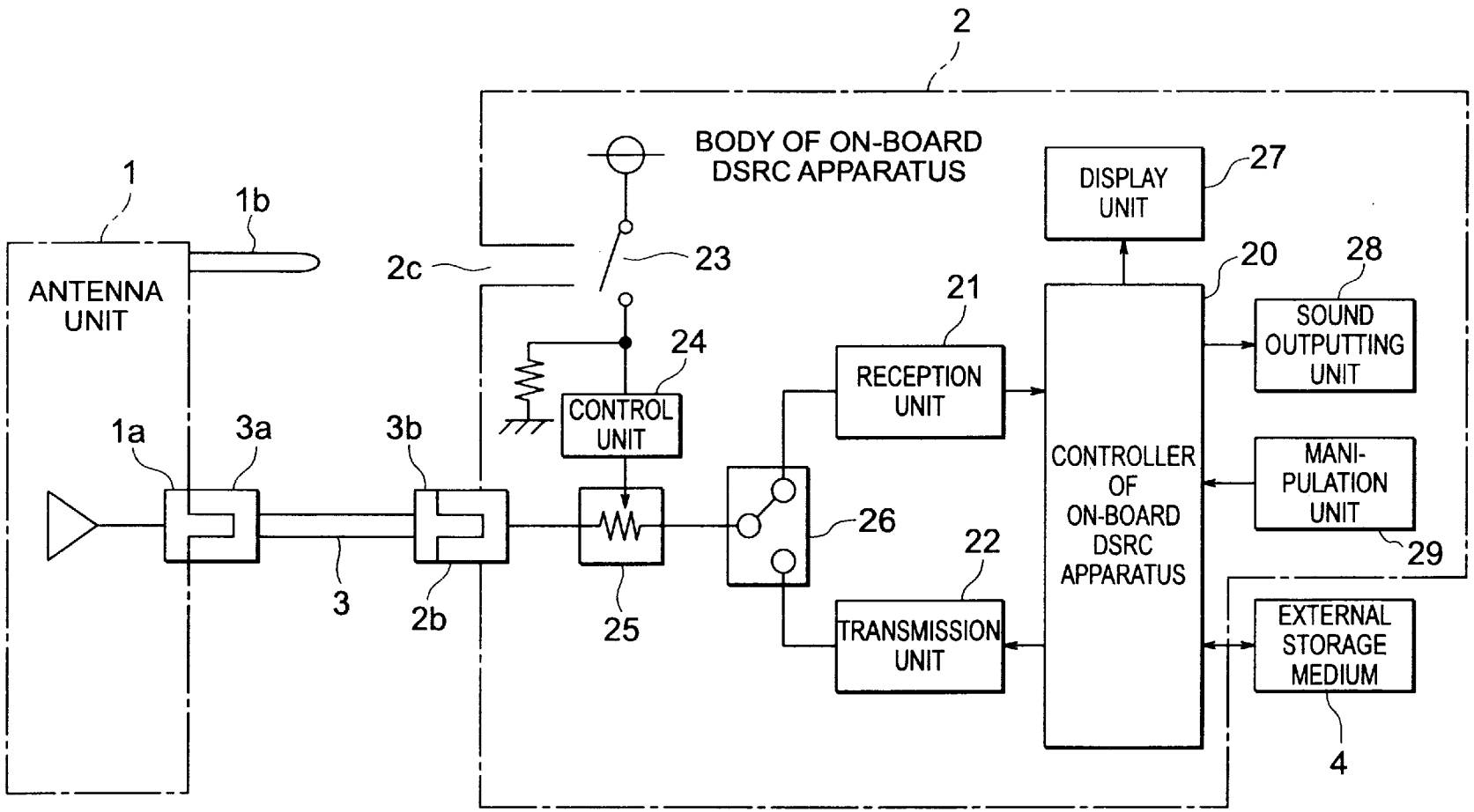
FIG. 1 is a circuit block diagram showing the configuration of an on-board DSRC apparatus according to a first embodiment of the present invention.
Figure 2:
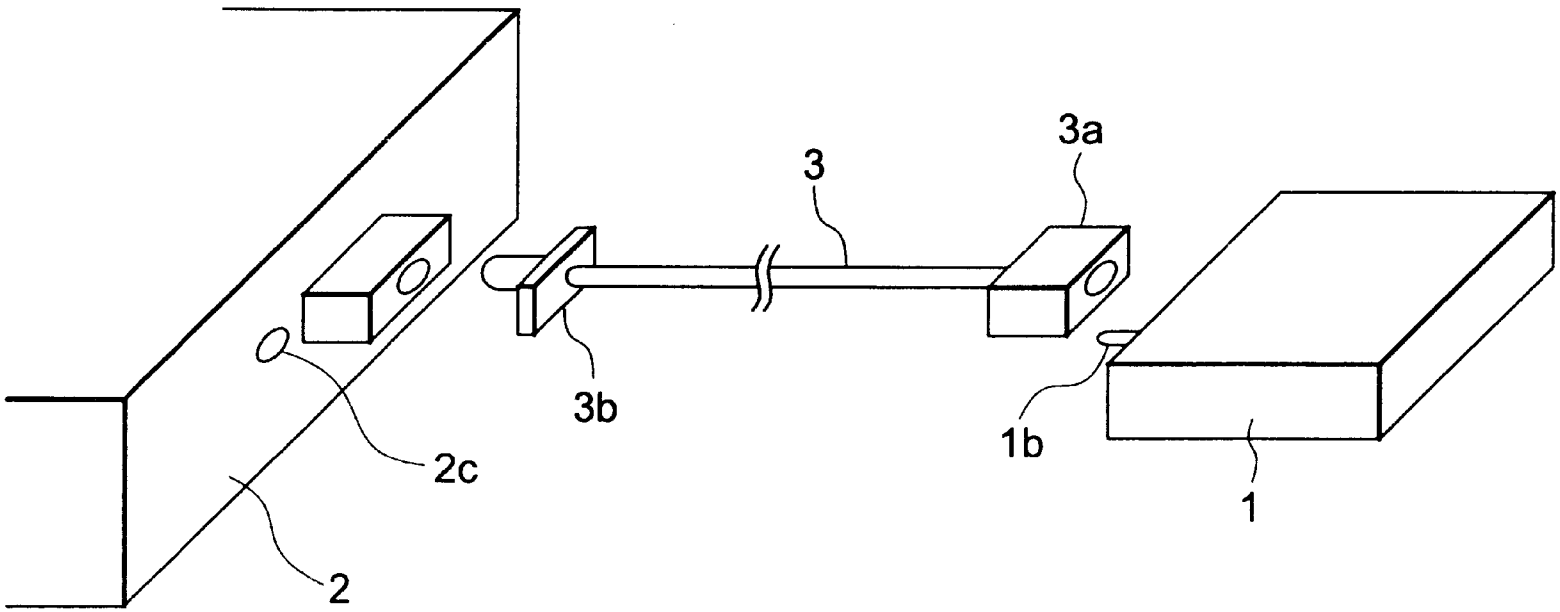
FIG. 2 is a perspective view schematically showing the external appearance of a main part of the on-board DSRC apparatus according to the first embodiment of the present invention.

FIG. 1 is a circuit block diagram showing the configuration of an on-board DSRC apparatus according to the first embodiment of the present invention, and FIG. 2 is a perspective view schematically showing the external appearance of a main part of the on-board DSRC apparatus according to the first embodiment of the present invention.

Figure 3:
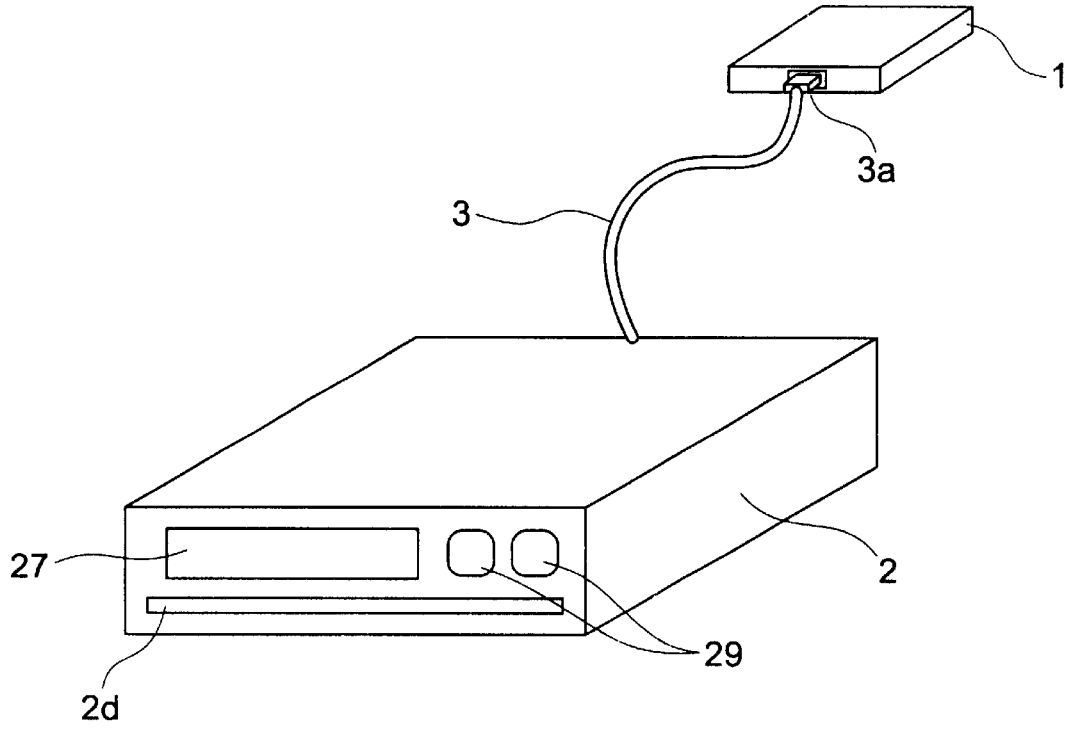
FIG. 3 is a perspective view schematically showing the external appearance of a three-piece type of on-board DSRC apparatus (in employment of a cable) according to the first embodiment of the present invention.
Figure 4:
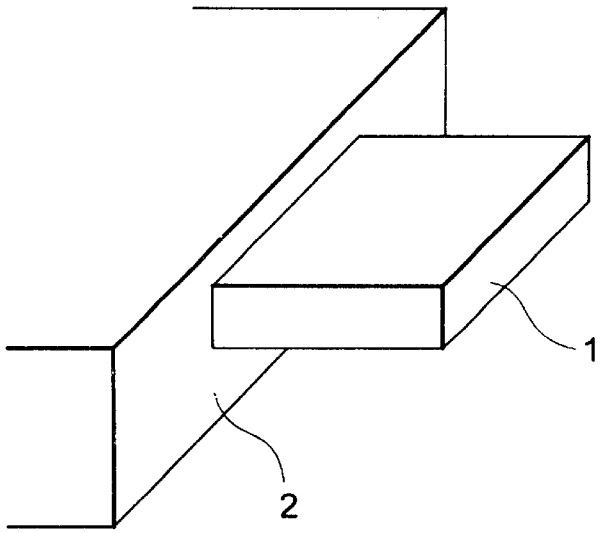
FIG. 4 is a perspective view schematically showing the external appearance of a two-piece type of on-board DSRC apparatus (in non-employment of a cable) according to the first embodiment of the present invention.

FIG. 3 is a perspective view schematically showing the external appearance of a three-piece type of on-board DSRC apparatus (in employment of a cable) according to the first embodiment of the present invention, and FIG. 4 is a perspective view schematically showing the external appearance of a two-piece type of on-board DSRC apparatus (in non-employment of a cable) according to the first embodiment of the present invention.

In FIGS. 1 to 4, an on-board DSRC (Dedicated Short-Range Communication) apparatus which is comprised of an on-board ETC (Electronic Toll Collection) apparatus, for example, includes: an antenna unit 1 which is mounted on a vehicle; a body 2 of the on-board DSRC apparatus which is mounted on the vehicle to be connected to the antenna unit 1; a cable 3 which is selectively inserted between the antenna unit 1 and the body 2 of the on-board DSRC apparatus;

and an external storage medium 4, such as an IC card, which is connected to the body 2 of the on-board DSRC apparatus. In this connection, each of the antenna unit 1 and the body 2 of the on-board DSRC apparatus is constructed in a chassis shape.

The antenna unit 1 is provided with a connector terminal 1*a* in such a way as to be connected to a connector terminal 3*a* which is provided at one side of the cable 3. Likewise, the body 2 of the on-board DSRC apparatus is provided with a connector terminal 2*b* in such a way as to be connected to a connector terminal 3*b* which is provided at the other side of the cable 3.

The surface side of the antenna unit 1 facing the body 2 of the on-board DSRC apparatus is provided with a projecting part 1*b*.

In addition, the surface side of the body 2 of the on-board DSRC apparatus facing the antenna unit 1 is provided with a recess part 2*c* into which the projecting part 1*b* can be inserted.

The body 2 of the on-board DSRC apparatus includes: a controller 20 of the on-board DSRC apparatus; and transmission and reception units associated with the antenna unit 1, i.e., a reception unit 21 and a transmission unit 22, and communicates with the associated one of on-road communication machines for charge collection (not shown) which is installed on a travelling road for the vehicle. The reception unit 21 and the transmission unit 22 are both connected to the controller 20 of the on-board DSRC apparatus.

In addition, the body 2 of the on-board DSRC apparatus includes: an opening and opening and closing switch 23; a control unit 24 which is driven in response to the turning-on operation of the opening and opening and closing switch 23; and a variable attenuator 25 for carrying out the correction in such a way as to increase the attenuation amount of the reception unit 21 and the transmission unit 22 in response to the drive by the control unit 24.

The projecting part 1*b*, the recess part 2*c* and the opening and opening and closing switch 23 constitute switch means which is operated in response to the presence or absence of the cable 3 (i.e., the type of the on-board DSRC apparatus), and the opening and opening and closing switch 23 is turned on by inserting the projecting part 1*b* into the recess part 2*c*.

The control unit 24 and the variable attenuator 25 constitute changing means for changing the attenuation amount (the circuit characteristics) of the reception unit 21 and the transmission unit 22 in response to the operation of the opening and opening and closing switch 23 (the switch means). Then, both of the control unit 24 and the variable attenuator 25 correct the attenuation amount in such a way as to compensate for the fluctuation of the cable loss due to the presence or absence of the cable 3.

In addition, the body 2 of the on-board DSRC apparatus includes a switch 26 for changing the transmission and reception which is inserted between the variable attenuator 25, and the reception unit 21 and the transmission unit 22. Then, the transmission and reception changing switch 26 operates to change the transmission and reception state under the control made by the controller 20 of the on-board DSRC apparatus.

A display unit 27 and a sound outputting unit 28 are connected as an output unit to the controller 20 of the on-board DSRC apparatus, and also a manipulation unit 29 which can be manipulated from the outside by a user is connected as an input unit to the controller 20 of the on-board DSRC apparatus.

The controller 20 of the on-board DSRC apparatus outputs the processing result of the communication information which is transmitted and received via the reception unit 21 and the transmission unit 22, respectively, from the output unit.

In this case, the case where the on-board DSRC apparatus is the on-board ETC apparatus is taken as an example. Then, the body 2 of the on-board DSRC apparatus, as shown in FIG. 3, includes a storage medium insertion unit 2d into which the external storage medium 4, such as an IC card, is inserted to and from which the information relating to the change collection is transmitted and received.

By adopting the above-mentioned configuration, the controller 20 of the on-board DSRC apparatus transmits and receives the information to and from the external storage medium 4 and also exchanges the information relating to the charge collection with the associated one of the on-road communication machines for charge collection which is installed on a toll road for the vehicle to automatically carry out the charge collection on the basis of the information relating to the charge collection.

Next, the concrete description will hereinafter be given with respect to the operation of automatically correcting the attenuation amount for the cable loss according to the first embodiment of the present invention with reference to FIGS. 1 to 4.

FIGS. 1 to 3 show the case of the three-piece type on-board DSRC apparatus having the cable 3, while FIG. 4 shows the case of the two-piece type of on-board DSRC apparatus in which the cable 3 is removed.

The reception unit 21 in the body 2 of the on-board DSRC apparatus demodulates the signal which has been received from the antenna unit 1 to input the resultant signal to the controller 20 of the on-board DSRC apparatus, while the transmission unit 22 modulates the signal which has been transmitted from the controller 20 of the on-board DSRC apparatus to output the resultant signal through the antenna unit 1 in the form of an electric wave.

In addition, a transmission and reception changing switch 26 selects the reception unit 21 or the transmission unit 22 to change the transmission and the reception over to each other.

The controller 20 of the on-board DSRC apparatus displays or announces the communication processing information which is necessary for a vehicle driver through the display unit 27 or the sound outputting unit 28, respectively.

A vehicle driver can manipulate the body 2 of the on-board DSRC apparatus through a manipulation unit 29 which is constituted of push-buttons and the like.

The controller 20 of the on-board DSRC apparatus controls the overall on-board DSRC apparatus having the above-mentioned configuration in accordance with the communication protocol between the on-board DSRC apparatus and the associated one of the on-board communication machines for charge collection.

On the other hand, as described above, connector terminals 3*a* and 3*b* (refer to FIG. 2) are provided at both ends of the cable 3, which are removably attached to the connector terminals 1*a* and 2*b*, respectively, provided in the antenna unit 1 and the body 2 of the on-board DSRC apparatus.

Therefore, in the case where the cable 3 is employed, as shown in FIG. 3, the on-board DSRC apparatus becomes of the three-piece type, while in the case of the cable 3 is not employed, as shown in FIG. 4, the on-board DSRC apparatus becomes of the two-piece type.

Now, when the cable 3 is removed from the three-piece type of on-board DSRC apparatus (refer to FIG. 3) to change the type of the on-board DSRC apparatus from the three-piece type over to the two-piece type (refer to FIG. 4), the antenna unit 1 and the body 2 of the on-board DSRC apparatus are directly coupled to each other to insert the projecting part 1*b* into the recess part 2*c*.

As a result, the associated part of the opening and opening and closing switch 23 is pushed by the projecting part 1*b* so that the opening and closing switch 23 is turned on to drive the control unit 24.

In other words, in the case where the type of the on-board DSRC apparatus is changed from the three-piece type over to the two-piece type, an ON signal is inputted from the opening and closing switch 23 to the control unit 24.

Therefore, the control unit 24 changes the associated part of the variable attenuator 25 to carry out the correction of the attenuation amount in dependence on the removal of the cable 3.

In the other words, the variable attenuator 25 increases the attenuation amount in such a way as to cancel out the increasing amount of the sensitivity (output) when removing the cable 3 to automatically correct the attenuation amount corresponding to the loss of the cable 3 which has been employed.

For example, in the case where the attenuation amount of the cable 3 which was employed when the on-board DSRC apparatus was of the three-piece type is 4 dB, the control unit 24 causes the attenuation of 4 dB through the variable attenuator 25.

As a result, the reception sensitivity and the transmission output when the on-board DSRC apparatus is of the three-piece type are maintained as they are even after having changed the type of the on-board DSRC apparatus from the three-piece type over to the two-piece type.

Therefore, even when the type of the on-board DSRC apparatus is changed in the manner as described above, the communication area is not changed even after having changed the type of the on-board DSRC apparatus from the three-piece type over to the two-piece type and hence is held fixed.

In such a way, the fluctuation for the loss due to the presence or absence of the cable 3 is automatically corrected, whereby the cable 3 can be removed therefrom without changing the transmission and reception characteristics and hence it is possible to cope freely with the request of ensuring the forward field of view or the like in dependence on the change of a user's preference or the change of a shape of a vehicle's interior.

That is, since the type of the on-board DSRC apparatus can be changed by connecting arbitrarily the body 2 of the on-board DSRC apparatus to the antenna unit 1, the installation position of which is limited, irrespective of whether or not the cable 3 is employed, it is possible to increase the degree of freedom of the installation positions of the antenna unit 1 and the body 2 of the on-board DSRC apparatus. In addition, it is possible to automatically correct the change amount of the cable loss irrespective of whether or not the cable 1 is employed.

In addition, giving consideration thereto from a standpoint of manufacturer of the on-board DSRC apparatus, since it is possible to apply the same product to any use, the high efficiency in manufacture can be realized.

In this connection, while the present embodiment has been described by taking as an example the specific case where the type of the on-board DSRC apparatus is changed from the three-piece type over to the two-piece type, it is to be understood that this also applies to the reverse case and the same operation and effects as those described above can be obtained in this case.

That is, the communication area can be held fixed without being spread or reduced and also it is possible to increase the degree of freedom of the installation positions of the antenna unit and the on-board DSRC apparatus.

In addition, while the present embodiment has been described by taking as an example the specific case where the on-board ETC apparatus is employed as the on-board DSRC apparatus; the antenna unit 1 and the body 2 of the on-board apparatus are both mounted in a vehicle which will travel along a toll road; and this vehicle exchanges the information relating to the charge collection with the associated one of the on-road communication machines for charge collection to automatically carry out the charge collection, even if the present invention is applied to any of other on-board DSRC apparatuses, the same operation and effects as those in the foregoing can be obtained.

Second Embodiment

In this connection, while in the above-mentioned first embodiment, the control unit 24 and the variable attenuator 25 are both employed as the changing means for changing the attenuation amount when changing the type of the on-board DSRC apparatus from one type over to the other type, alternatively, both of high-frequency switches each of which responds to the turning-on operation of the opening and closing switch 23, and a fixed attenuator which is selectively connected to the transmission and reception units through the high-frequency switch may also be employed as the changing means.

Figure 5:
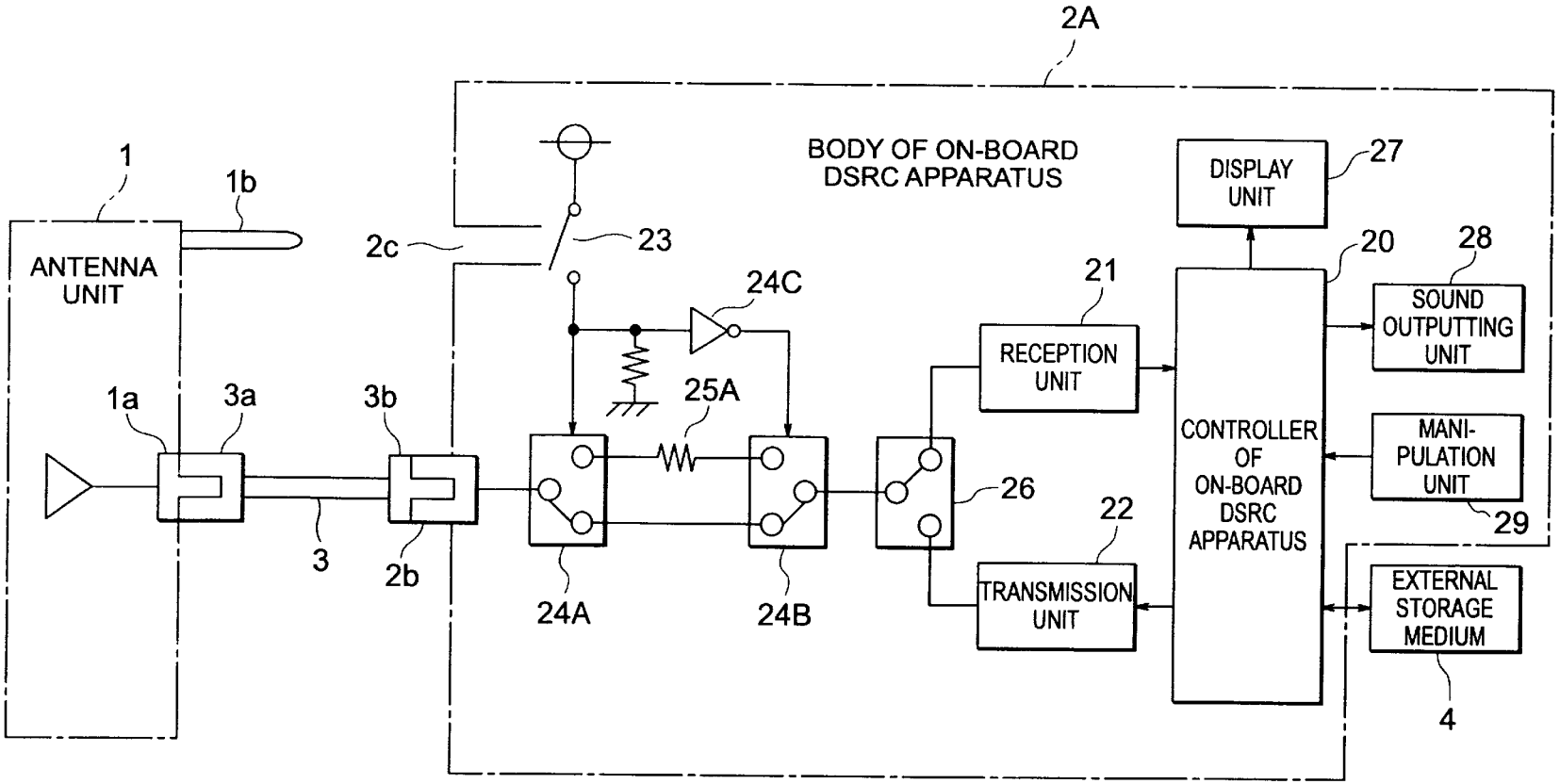
FIG. 5 is a circuit block diagram showing the configuration of an on-board DSRC apparatus according to a second embodiment of the present invention.

FIG. 5 is a circuit block diagram showing the configuration of the on-board DSRC apparatus according to a second embodiment of the present invention in which both of high-frequency switches and a fixed attenuator are employed as the changing means. In the figure, parts similar to those of the first embodiment (refer to FIG. 1) are designated by the same reference numerals and the detailed description thereof is omitted here for the sake of simplicity.

In FIG. 5, a body 2A of an on-board DSRC apparatus includes, as the changing means for responding to the turning-on operation of the opening and closing switch 23: high-frequency switches 24A and 24B for carrying out the switching operation therefor in conjunction with the turning-on operation of the opening and closing switch 23; and a fixed attenuator 25A which is selectively connected to the reception unit 21 and the transmission unit 22 through the high-frequency switches 24A and 24B, respectively.

In addition, an inverter 24C is provided between the opening and closing switch 23 and the high-frequency switch 24B.

The fixed attenuator 25A, in the case of the three-piece type (in the case of employment of the cable 3), is not connected to the transmission and reception units as shown in the figure, while in the case of the two-piece type (in the case of non-employment of the cable 3), is connected to the transmission and reception units by reversely activating the high-frequency switches 24A and 24B.

That is, when the type of the on-board DSRC apparatus is changed from the three-piece type over to the two-piece type, both of the high-frequency switches 24A and 24B are switched over to the fixed attenuator 25A side on the basis of the turning-on operation of the opening and closing switch 23.

At this time, the attenuation amount of the fixed attenuator 25A, similarly to the foregoing, corresponds to the loss (for example, 4 dB) due to the distribution of the cable 3. As a result, the reception sensitivity, the transmission output and the communication area, even when changing the type of interest to either the two-piece type or the three-piece type, are not changed and hence are respectively held fixed.

Third Embodiment

In this connection, while in the above-mentioned first embodiment, the opening and closing switch 23 is employed as the switch means for detecting the change of the type of the on-board DSRC apparatus, alternatively, other switch means, e.g., a magnetic switch may, instead thereof, be employed as the switch means.

That is, the switch means (not shown) may be constituted of a magnet member which is provided on the surface side of the antenna unit 1 facing the body 2 of the on-board DSRC apparatus, and a magnetic switch which is provided on the surface side of the body 2 of the on-board DSRC apparatus facing the antenna unit 1. Since other configurations and the operation thereof are the same as those described above, the detailed description thereof is omitted here for the sake of simplicity.

In this case, since the magnet member is made come close to the magnetic switch so that the magnetic switch is turned on, a moving switch becomes unnecessary.

Therefore, according to the third embodiment, the switch means can be constructed with a simpler configuration as compared with the case where the above-mentioned opening and closing switch 23 is employed.

While the present invention has been particularly shown and described with reference to the preferred embodiments, it will be understood that the various changes and modifications will occur to those skilled in the art without departing from the scope and true spirit of the invention. The scope of the invention is therefore to be determined solely by the appended claims.

What is claimed is:

1. An on-board Dedicated short range communication (DSRC) apparatus comprising an antenna unit mounted on a vehicle, and a body of said on-board DSRC apparatus mounted on the vehicle to be connected to said antenna unit, said body including a transmission and reception units associated with said antenna unit to communicate with the associated one of on-road communication machines that is installed on a travelling road for the vehicle, wherein said body of said on-board DSRC apparatus comprises switch means for operating in response to the presence or absence of a cable which is selectively inserted between said antenna unit and said body of said on-board DSRC apparatus, and changing means for changing the attenuation amount of said transmission and reception units in response to the operation of said switch means, and wherein said changing means corrects the attenuation amount in such a way as to compensate for the fluctuation of the cable loss due to the presence or absence of said cable.

2. An on-board DSRC apparatus according to claim 1, wherein said switch means is constituted of:

a projecting part which is provided on the surface side of said antenna unit facing said body of said on-board DSRC apparatus;

a recess part which is provided on the surface side of said body of said on-board DSRC apparatus facing said antenna unit;

and an opening and closing switch which is turned on by inserting said projecting part into said recess part.

3. An on-board DSRC apparatus according to claim 1, wherein said switch means is constituted of a magnet member which is provided on the surface side of said antenna unit facing said body of said on-board DSRC apparatus, and a magnetic switch which is provided on the surface side of said body of said on-board DSRC apparatus facing said antenna unit and which is turned on by making said magnet member come close to said magnetic switch.

4. An on-board DSRC apparatus according to claim 1, wherein said changing means is constituted of a control unit which is operated by turning on said switch means, and a variable attenuator for carrying out the correction in such a way as to increase the attenuation amount of said transmission and reception units in response to the drive by said control unit.

5. An on-board DSRC apparatus according to claim 1, wherein said changing means is constituted of high-frequency switches for carrying out the change operation in conjunction with the on operation of said switch means, and a fixed attenuator which is selectively connected to said transmission and reception units through said high-frequency switches.

6. An on-board DSRC apparatus according to claim 1, wherein said body of said on-board DSRC apparatus includes a controller of said on-board DSRC apparatus for processing communication information which has been transmitted and received through said transmission and reception units, and a storage medium insertion unit into which an external storage medium is inserted to and from which the information relating to the charge collection is transmitted and received through said controller of said on-board DSRC apparatus, and wherein said body exchanges the information relating to the charge collection with the associated one of on-road communication machines for charge collection which is installed on a toll road for the vehicle, and automatically carries out the charge collection on the basis of the information relating to the charge collection.

* * * * *